US006655346B2

(12) United States Patent
Esteghlal et al.

(10) Patent No.: US 6,655,346 B2
(45) Date of Patent: Dec. 2, 2003

(54) METHOD FOR ADAPTING MIXTURE CONTROL IN INTERNAL COMBUSTION ENGINES WITH DIRECT FUEL INJECTION

(75) Inventors: Gholamabas Esteghlal, Ludwigsburg (DE); Dieter Lederer, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/129,088

(22) PCT Filed: Aug. 31, 2001

(86) PCT No.: PCT/DE01/03290

§ 371 (c)(1),
(2), (4) Date: Aug. 21, 2002

(87) PCT Pub. No.: WO02/18768

PCT Pub. Date: Mar. 7, 2002

(65) Prior Publication Data

US 2003/0101963 A1 Jun. 5, 2003

(30) Foreign Application Priority Data

Sep. 28, 2000 (DE) ..... 100 43 072

(51) Int. Cl.[7] ..... F02B 17/00
(52) U.S. Cl. ..... 123/295; 123/305; 123/520
(58) Field of Search ..... 123/295, 299, 123/300, 520, 479, 304, 526

(56) References Cited

U.S. PATENT DOCUMENTS 4,584,982 A 4/1986 Clement et al.
6,202,601 B1 * 3/2001 Ouellette et al. ..... 123/27 GE
6,286,482 B1 * 9/2001 Flynn et al. ..... 123/435
6,463,907 B1 * 10/2002 Hiltner ..... 123/304
6,467,495 B2 * 10/2002 Shost ..... 137/15.18
6,484,689 B1 * 11/2002 Hasegawa ..... 123/299
6,516,782 B1 * 2/2003 Thomas ..... 123/436

FOREIGN PATENT DOCUMENTS

| | | |
|---|---|---|
| DE | 197 44 230 | 4/1999 |
| DE | 198 50 586 | 5/2000 |
| EP | 0 803 646 | 10/1997 |
| EP | 0 947 684 | 10/1999 |
| EP | WO 02/18768 A1 * | 3/2003 |
| WO | WO 00 49473 | 8/2000 |

* cited by examiner

*Primary Examiner*—John Kwon
(74) *Attorney, Agent, or Firm*—Kenyon & Kenyon

(57) ABSTRACT

A method for compensating for faulty adaptations of the pilot control of fuel metering for an internal combustion engine which is operated in the at least two different operating modes, homogeneous mode and stratified charge mode, is described with mixture regulation and adaptation of mixture regulation taking place in homogeneous mode, and switching taking place between the operating modes, depending on a desired operating mode which is determined from a plurality of operating mode requirements, each of the operating mode requirements being assigned a priority, and the desired operating mode being determined depending on the priorities of the operating mode requirements, the physical priority of the adaptation being elevated in different time references, thus requiring a switch to homogeneous mode

8 Claims, 3 Drawing Sheets

METHOD FOR ADAPTING MIXTURE CONTROL IN INTERNAL COMBUSTION ENGINES WITH DIRECT FUEL INJECTION

BACKGROUND INFORMATION

It is known in the regulation of the fuel/air ratio of internal combustion engines to superimpose a pilot control having a regulation. It is further known that additional correcting quantities can be derived from the behavior of the regulating quantity to compensate for faulty adaptations of the pilot control to modified operating conditions. This compensation is also referred to as adaptation. U.S. Pat. No. 4,584,982 describes, for example, an adaptation with different adaptation quantities in various ranges of the load/speed spectrum of an internal combustion engine. The various adaptation quantities are directed toward compensation for different errors. Three types of errors may be distinguished, according to their cause and effect: errors of a hot film air flow sensor, which have a multiplicative effect on the fuel metering; air leakage influences, which have an additive effect per unit of time; and errors in the compensation of pickup delays of injection valves, which have an additive effect per injection.

Under regulatory requirements, errors pertaining to exhaust gas emissions must be detected by onboard means, optionally with the activation of a malfunction light. Mixture adaptation is also used for fault diagnosis. An error is indicated if, for example, the corrective intervention of the adaptation is too great.

Over the operating life, for the manufacturing tolerance and during unregulated sensor heating, the measured lambda value deviates from the lambda value which is physically present, primarily in the stratified charge mode in engines having direct gasoline injection. Since the mixture adaptation takes the measured lambda into account for error learning, the adaptation in stratified charge mode does not lead to the desired result. For the adaptation, therefore, the operation is switched to homogeneous mode and mixture adaptation is activated.

An engine control program is known from German Patent 198 50 586 which controls switching between stratified charge mode and homogeneous mode.

In stratified charge mode, the engine is operated with a highly stratified cylinder charge and high excess air to obtain the lowest possible fuel consumption. The stratified charge is achieved by delayed fuel injection, which ideally results in a division of the combustion chamber into two zones, with the first zone containing a combustible air-fuel cloud mixture at the spark plug. The first zone is surrounded by the second zone which has an insulating layer composed of air and residual gas. Consumption may be optimized by operating the engine largely unthrottled while avoiding charge exchange losses. The stratified charge mode is preferred at comparatively low load.

At higher load, when optimization of performance is of chief importance, the engine is operated with homogeneous cylinder filling. Homogeneous cylinder filling results from early fuel injection during the intake process. Consequently, there is more time for forming a mixture up to the point of combustion. Performance may be optimized in this mode of operation, for example, by making use of the entire volume of the combustion chamber for filling with the combustible mixture.

Several starting conditions are necessary with regard to adaptation:

For example, the engine temperature must have reached the starting temperature threshold, and the lambda sensor must be ready to operate. In addition, the current values of load and rotational speed must be situated in specific ranges in which learning occurs. This is known from U.S. Pat. No. 4,584,982, for example. Furthermore, the operation must be in homogeneous mode. According to the known program, the mixture adaptation is activated in fixed time intervals.

This may result in a conflict with other control functions, such as the control of tank venting. This control function must be active when the activated carbon filter is under high load. In addition, it is desirable to activate mixture adaptation when the activated carbon filter is under a lesser load and the adaptation is not completely ended.

SUMMARY OF THE INVENTION

In light of this background, the object of the present invention is to increase the time period in which the engine is capable of being operated in stratified charge mode with optimal consumption. Switching to homogeneous mode for diagnosis reduces the consumption-related advantages of direct gasoline injection, since homogeneous mode is more unfavorable for consumption than stratified charge mode. Switching to homogeneous mode, which is performed especially for diagnosis, unnecessarily increases the fuel consumption when an error is not present. Switching to homogeneous mode should thus be avoided to the greatest extent possible without compromising the detection of exhaust gas-related errors.

This effect is achieved by the features of claim 1.

In particular, the following steps are carried out for this purpose: for compensating for faulty adaptations of the pilot control of fuel metering for an internal combustion engine which is operated in the at least two different operating modes, homogeneous mode and stratified charge mode, mixture regulation and adaptation of mixture regulation take place in homogeneous mode with switching taking place between the operating modes, depending on a desired operating mode which is determined from a plurality of operating mode requirements, each of the operating mode requirements being assigned a priority, and-with the desired operating mode being determined depending on the priorities of the operating mode requirements. The physical priority of the adaptation is elevated in different time references, thus requiring a switch to homogeneous mode.

The requirement of the homogeneous mode for mixture adaptation is thus optimized so that regulatory requirements are satisfied.

A further embodiment provides that the time reference depends on whether an error or suspected error is present.

A further embodiment provides that the engine control program contains, among other elements, a program module which functions as a phase discriminator, a program module which functions as a base adaptation requester GA_requestor, a program module which functions as a base adaptation stop GA_stop, and a program module which functions as an end discriminator.

A further embodiment provides that, for low load on the activated carbon filter, the mixture adaptation requestor (GA_requester) program module requests mixture adaptation (GA) for a time TGAPA of less than one minute if the other starting conditions of the mixture adaptation have been met.

A further embodiment provides that the mixture adaptation stop (GA_stop) program module prohibits the phase discriminator from requesting mixture adaptation when the activated carbon filter has a high fuel load and when mixture adaptation is ended.

A further embodiment provides that the phase discriminator program module elevates the physical priority of the mixture adaptation in different time references, thus requiring a switch to homogeneous mode.

A further embodiment provides that these time references depend on whether an error is known to the control unit or whether a suspected error is present.

The present invention is also based on an electronic control device for carrying out at least one of the described methods and embodiments.

In normal everyday operation of the motor vehicle, switching to homogeneous mode is requested only when mixture adaptation is also able to become active. If no errors are present in the system, the mixture adaptation is activated only within certain time intervals. The time segments in which the motor vehicle may be operated favorably for consumption in stratified charge mode may thus be increased over an average time.

BRIEF DESCRIPTION OF THE DRAWING

An exemplary embodiment of the present invention is explained hereinafter with reference to the drawing.

DETAILED DESCRIPTION OF THE EMBODIMENTS

Figure 1:
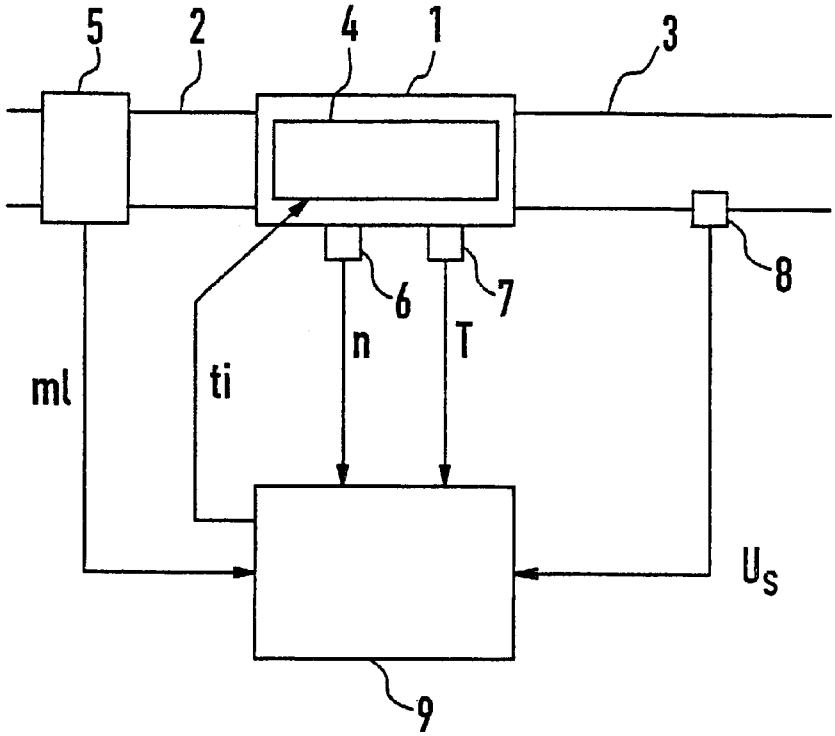
FIG. 1 shows the technical field of the present invention.

Reference number 1 in FIG. 1 represents an internal combustion engine having an intake pipe 2, an exhaust pipe 3, fuel metering means 4, sensors 5 through 8 for operational parameters of the engine, and a control unit 9. Fuel metering means 4 may include, for example, an arrangement of injection valves for direct injection of fuel into the combustion chambers of the internal combustion engine.

Sensor 5 sends a signal to the control unit via air flow ml which is drawn in by the engine. Sensor 6 sends an engine speed signal n. Sensor 7 provides information on the engine temperature T, and sensor 8 sends a signal Us indicating the engine exhaust gas composition. From these and optionally additional signals regarding other engine operating parameters, the control unit forms, in addition to other control variables, fuel metering signals ti to actuate fuel metering means 4 in such a way that a desired engine response, particularly a desired exhaust gas composition, may be established.

Figure 2:
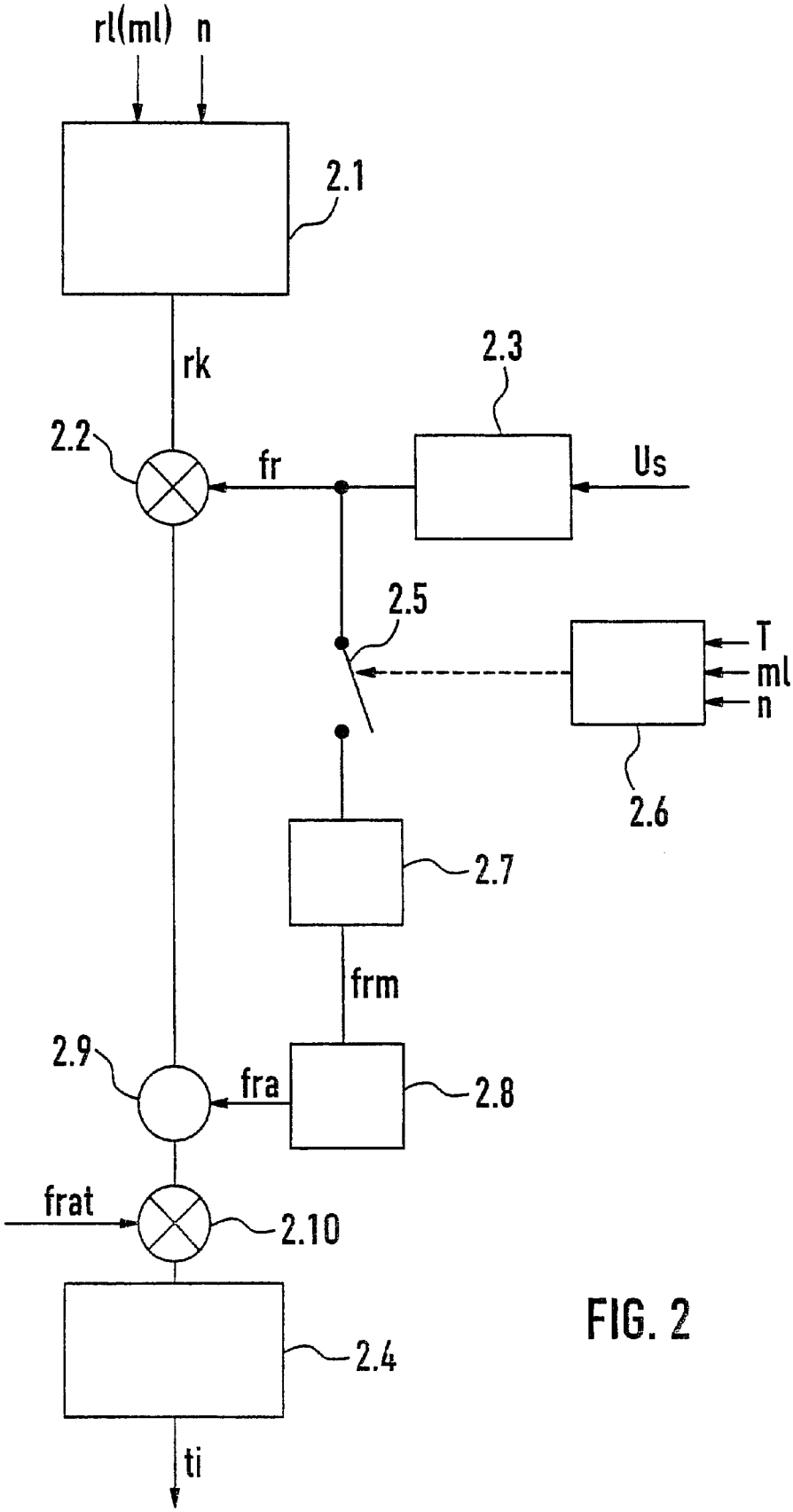
FIG. 2 illustrates the formation of a fuel metering signal based on the signals from FIG. 1.

FIG. 2 shows the formation of the fuel metering signal. Block 2.1 represents a characteristic field which is addressed by rotational speed n and relative air filling rl, and in which pilot control values rk for the formation of fuel metering signals are recorded. Relative air filling rl is based on a maximum filling of the combustion chamber with air, thereby indicating to a certain extent the fraction of maximum filling of the combustion chamber or cylinder. Relative air filling rl is based essentially on signal ml. rk corresponds to the quantity of fuel which is allocated to quantity of air rl.

Block 2.2 shows the known multiplicative lambda regulation intervention. A faulty adaptation of the quantity of fuel to the quantity of air is indicated by signal Us from the exhaust probe. From signal Us a regulator 2.3 forms regulating quantity fr which reduces the faulty adaptation by intervention 2.2.

The metering signal, for example, an actuation pulse duration for the injection valves, may be formed in block 2.4 from the signal thus corrected. Thus, block 2.4 represents the conversion of the relative and corrected quantities of fuel into a real actuation signal, taking the fuel pressure, injection valve geometry, and the like into account.

Blocks 2.5 through 2.9 represent the known operating parameter-dependent mixture adaptation, which may have a multiplicative and/or additive effect. Circle 2.9 represents these three possibilities. Switch 2.5 is opened or closed by means 2.6, which is supplied with operating parameters of the internal combustion engine such as temperature T, air flow ml, and rotational speed n. Means 2.6 in conjunction with switch 2.5 thus allows the three referenced adaptation possibilities to be activated, depending on the operating parameter. The formation of adaptation intervention fra onto the fuel metering signal formation is illustrated by blocks 2.7 and 2.8. When switch 2.5 is closed, block 2.7 forms average value frm of regulating quantity fr. Deviations of average value frm from the neutral value 1 are taken by block 2.8 into adaptation intervention quantity fra. For example, if regulating quantity fr first goes to 1.05 as the result of a faulty adaptation of the pilot control, the deviation of 0.05 from the value 1 is taken by block 2.8 into value fra of the adaptation intervention. For a multiplicative fra intervention, fra then goes to 1.05, with the result that fr returns to 1. The adaptation thus assures that faulty adaptations of the pilot control need not be readjusted for every change in the operating point. This adjustment of adaptation quantity fra is performed at high temperatures in the internal combustion engine, such as above a cooling water temperature of 70° C., with switch 2.5 at that time being in the closed state. Once adjusted, however, fra affects the formation of the fuel metering signal even when switch 2.5 is open.

FIG. 3 shows a schematic representation of an exemplary embodiment of operating mode switching.

Figure 3A:
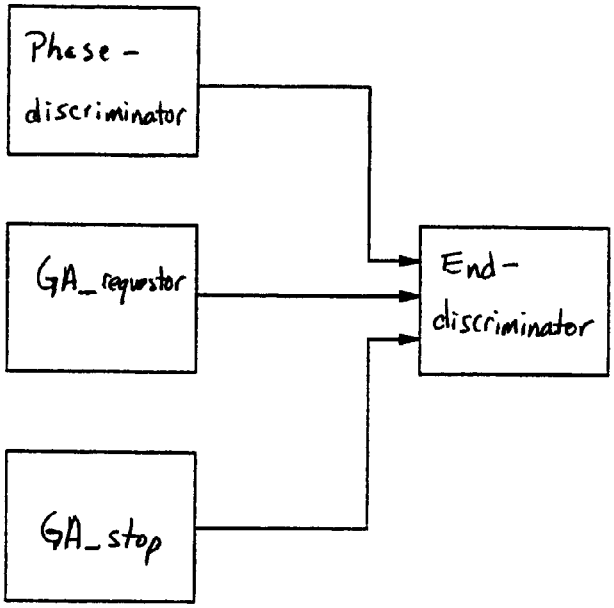
FIG. 3 shows a schematic representation of an exemplary embodiment of operating mode switching.

The engine control program contains, among other elements, a program module which is designated as a phase discriminator, a program module which is designated as a base adaptation requester GA_requestor, a program module which is designated as a base adaptation stop GA_stop, and a program module which is designated as an end discriminator. This is illustrated in FIG. 3*a*.

The phase discriminator program module elevates the physical priority of the mixture adaptation in different time references, thus requiring a switch to homogeneous mode. This is illustrated in FIG. 3*b*.

These time references depend on whether an error is known to the control unit or whether a suspected error is present. An error or suspected error may be set by a diagnostic program as a software-programmable bit. In the following description, it will be assumed that an error or suspected error is a known quantity in the control unit. If no suspected error is present in the control unit when the internal combustion engine is started, after initialization in state 3.1 no mixture adaptation is required at first for a time tteofini of half an hour (state 3.2), as shown in FIG. 3*b*. If during this time an error is detected by a diagnostic function, or an error was known from the last trip as a result of the diagnosis, time tteofini in state 3.2 is shortened to ttefvini of several minutes duration. In the absence of errors, after time tteofini, mixture adaptation is requested for a period of a few minutes (state 3.3). This represents a relatively long time for the mixture adaptation, since mixture adaptation is capable of learning errors within a few minutes. In the event of an error, after time ttefvini, mixture adaptation is required for approximately half the time (state 3.4). The referenced times are initialization times for faulty or fault-free systems, respectively.

After the initialization time, if the mixture adaptation has been checked, no mixture adaptation is requested for long times ttegae of 10 minutes duration in state 3.5, and mixture adaptation is requested for short times tgagae of one to two minutes duration in state 3.6. If an error appears in the time period having no mixture adaptation, the loop containing states 3.5 and 3.6 is changed into a loop having altered time references. This is shown in FIG. 3*b* by a branching of state 3.5 into the loop containing states 3.8 and 3.7. In state 3.7 no mixture adaptation is requested for short times ttengae of a few minutes duration, and in state 3.8, mixture adaptation is likewise requested for a time tgangae of a few minutes duration. This loop may optionally be reached from state 3.6. On the other hand, if the mixture adaptation has not yet been checked, the loop containing states 3.7 and 3.8 is reached directly from states 3.4 or 3.3. The phase discriminator is implemented as state automation. This is understood to mean a switching function algorithm, designed as a program module within the engine control program, which controls the transition between states having different durations.

Figure 3C:
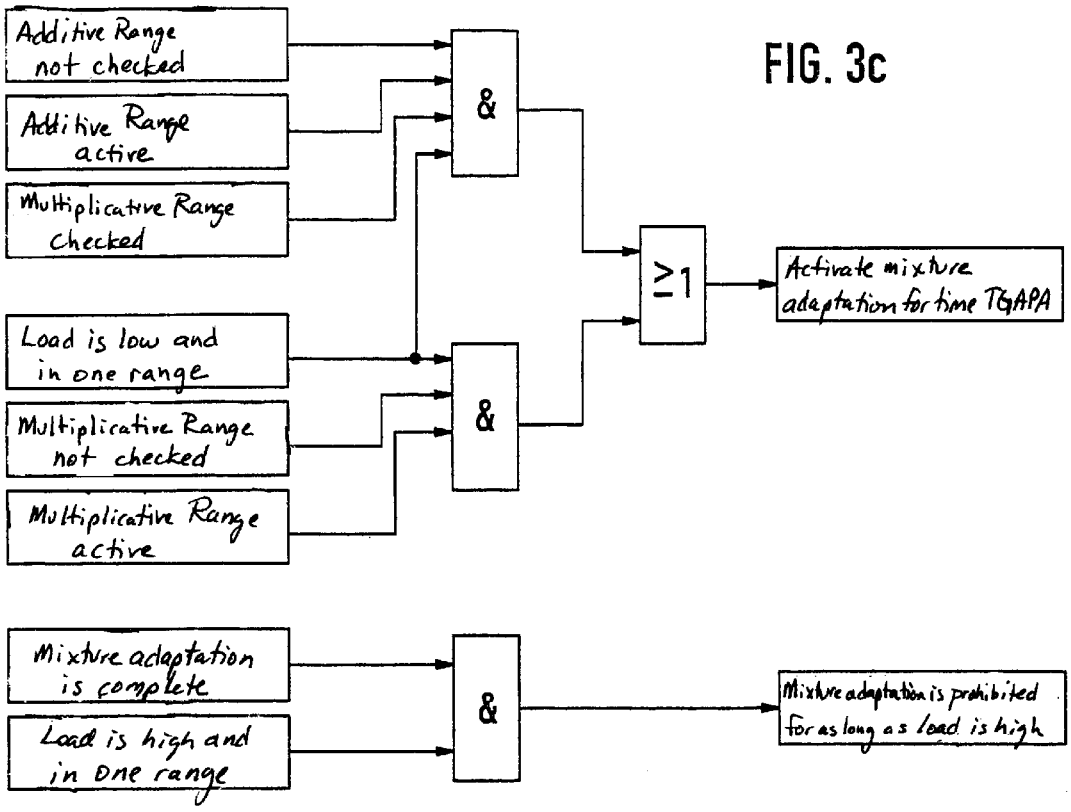
Figure 3B:
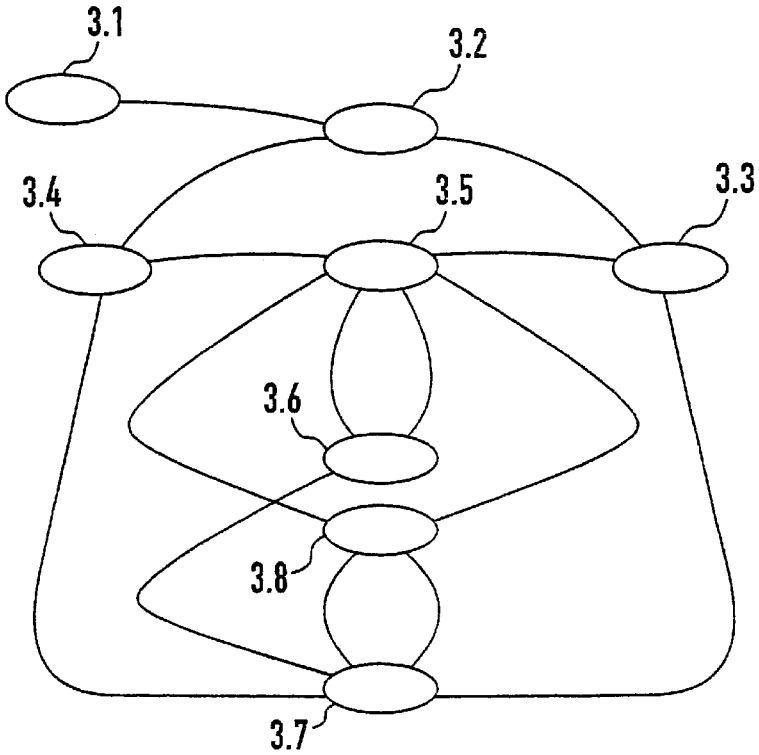

The request and prohibition of mixture adaptation is represented in FIG. 3*c*. When the activated carbon filter has a low load and the cycle flag for additive or multiplicative adaptation correction is not set, mixture adaptation requester GA_requester program module requests mixture adaptation GA for a time TGAPA of less than one minute if the other starting conditions of the mixture adaptation have been met. This requirement may be activated either for homogeneous mode alone or for all operating modes.

Base adaptation stop GA_stop program module prohibits a request by the phase discriminator for mixture adaptation when the activated carbon filter has a high fuel load and when mixture adaptation has ended.

What is claimed is:

1. A method for compensating for a faulty adaptation of a pilot control for metering a fuel of an internal combustion engine, comprising:

operating the engine in at least two different operating modes including a homogeneous mode and a stratified charge mode;

performing a mixture regulation and an adaption of the mixture regulation in the homogenous mode;

assigning a priority to each of a plurality of operating mode requirements;

determining a desired operating mode from the plurality of operating mode requirements, the desired operating mode being determined depending on the priorities assigned to the operating mode requirements;

switching between the at least two different operating modes, the switching depending on the desired operating mode; and switching to the homogeneous mode in response to elevating a physical priority of the adaptation in different time references.

2. The method according to claim 1, wherein the different time references depend on one of whether an error is present and whether a suspected error is present.

3. The method according to claim 1, wherein a program module of an engine control program is capable of:

performing a phase discrimination function, performing a base adaptation requestor function, performing a base adaptation stop function, and performing an end discrimination function.

4. The method according to claim 3, wherein a mixture adaptation requestor program module is capable of:

requesting mixture adaptation for a time of less than one minute if other starting conditions of the mixture adaptation have been met and if an activated carbon filter is under a low load.

5. The method according to claim 3, wherein a mixture adaptation stop module is capable of:

prohibiting the phase discrimination function from requesting mixture adaptation if an activated carbon filter has a high fuel load and if mixture adaptation is ended.

6. The method according to claim 3, wherein the elevating is performed by the phase discrimination function.

7. The method according to claim 6, wherein the different time references depend on one of whether an error is known to a control unit and whether a suspected error is present.

8. An electronic control device for compensating for a faulty adaptation of a pilot control for metering a fuel of an internal combustion engine, comprising:

an arrangement for operating the engine in at least two different operating modes including a homogeneous mode and a stratified charge mode;

an arrangement for performing a mixture regulation and an adaption of the mixture regulation in the homogenous mode;

an arrangement for assigning a priority to each of a plurality of operating mode requirements;

an arrangement for determining a desired operating mode from the plurality of operating mode requirements, the desired operating mode being determined depending on the priorities assigned to the operating mode requirements;

an arrangement for switching between the at least two different operating modes, the switching depending on the desired operating mode; and an arrangement for switching to the homogeneous mode in response to elevating a physical priority of the adaptation in different time references.

* * * * *

UNITED STATES PATENT AND TRADEMARK OFFICE

CERTIFICATE OF CORRECTION

PATENT NO. : 6,655,346 B2 
DATED : December 2, 2003
INVENTOR(S) : Gholamabas Esteghlal et al.

It is certified that error appears in the above-identified patent and that said Letters Patent is hereby corrected as shown below:

Title page,
Item [57], ABSTRACT,
Lines 7 and 9, change “taking place” to -- occurring --
Line 14, change “requirements, the” to -- requirements, and the --
Line 16, change “mode” to -- mode. --

Column 1,
Line 5, change “BACKGROUND INFORMATION” to -- FIELD OF THE INVENTION --
Line 6, change “It is known” to -- The present invention relates to a method for adapting mixtures for internal combustion engines.
BACKGROUND INFORMATION It is believed that --
Line 8, change “regulation” to -- regulation may be superimposed. --
Line 8, change “known” to -- believed --
Line 9, change “can” to -- may --
Line 12, change “is also referred” to -- may also be referred --
Line 12, change “Patent” to -- Pat. No. --
Lines 16 and 64, change “are” to -- may be --
Lines 19, 20 and 22, change “which have” to -- which may have --
Line 25, change “by onboard means” to -- by an onboard arrangement --
Lines 25 and 66, change “must” to -- may need to --
Line 26, change “is also used” to -- may also be used --
Lines 26, 38, 39, 43, 46, 49, 55, 56 and 59, change “is” to -- may be --
Line 31, change “deviates” to -- may deviate --
Line 35, change “takes” to -- may take --
Line 36, change “does not” to -- may not --
Line 40, change “known from” to -- described in --
Lines 40-41, change “Patent” to -- Published Patent Application No. --
Line 41, change “controls” to -- may control --
Line 46, change “ideally results” to -- may ideally result --
Line 50, change “has” to -- may include --
Line 53, change “is preferred” to -- may be --
Line 57, change “results” to -- may result --

Column 2,
Lines 1 and 4, change “must” to -- may need to --
Line 2, change “must be situated” to -- may need to be arranged --
Line 3, change “is known from” to -- may be described in --
Line 3, change “Patent (Pat)” to -- Published Patent Application No. --
Lines 4 and 9, change “must” to -- may need to --

UNITED STATES PATENT AND TRADEMARK OFFICE

CERTIFICATE OF CORRECTION

PATENT NO. : 6,655,346 B2
DATED : December 2, 2003
INVENTOR(S) : Gholamabas Esteghlal et al.

It is certified that error appears in the above-identified patent and that said Letters Patent is hereby corrected as shown below:

Column 2 (cont'd),
Line 5, delete "known"
Line 6, change "is" to -- may be --
Lines 10, 17, 21, 22, 29, 38 and 44, change "is" to -- may be --
Line 16, change "the" to -- an --
Line 20, change "reduces" to -- may reduce --
Line 23, change "unnecessarily increases" to -- may unnecessarily increase --
Line 25, change "should thus" to -- may need to --
Line 29, change "claim 1" to -- the present invention --
Line 30, change "are carried at" to -- may be performed --
Line 36, change "take place" to -- may occur --
Line 37, change "taking place" to -- occurring --
Line 38, change "modes, depending" to -- modes. Depending --
Line 40, change "being" to -- is --
Line 41, change "priority, and –with" to -- priority. --
Line 41, change "desired" to -- The desired --
Line 42, change "being" to -- may be --
Line 48, change "is thus" to -- may thus be --
Line 49, change "are" to -- may be --
Lines 50 and 52, change "embodiment" to -- exemplary embodiment --
Lines 50 and 52, change "provides" to -- may provide --
Line 51, change "depends" to -- depend --
Line 53, change "contains" to -- contain --
Lines 54, 55, 56 and 58, change "functions" to -- may function --
Lines 59 and 65, change "embodiment provides" to -- exemplary embodiment may provide --
Line 61, change "requests" to -- request --
Line 66, change "prohibits" to -- prohibit --

Column 3,
Line 3, change "embodiment may provide" to -- exemplary embodiment may provide --
Line 4, change "elevates" to -- elevate --
Line 7, change "embodiment provides" to -- exemplary embodiment may provide --
Line 10, change "is also based on" to -- may also relate to --
Line 11, change "carrying out" to -- performing --
Line 12, change "methods and embodiments" to -- exemplary methods and exemplary embodiments --
Lines 14 and 16, change "is" to -- may be --
Line 21, change "DRAWING" to -- DRAWINGS --

UNITED STATES PATENT AND TRADEMARK OFFICE

CERTIFICATE OF CORRECTION

PATENT NO. : 6,655,346 B2 
DATED : December 2, 2003
INVENTOR(S) : Gholamabas Esteghlal et al.

It is certified that error appears in the above-identified patent and that said Letters Patent is hereby corrected as shown below:

Column 3 (cont'd),
Line 25, change "FIG. 1 shows the" to -- FIG. 1 shows a --
Line 25, change ";" to -- . --
Lines 23-24, delete "An exemplary...the drawing"
Line 26, change "the" to -- a --
Line 27, change ";and" to -- . --
Lines 32-33, delete "OF THE EMBODIMENTS"
Lines 35, 37 and 49, change "means" to -- arrangement --
Line 49, change "way" to -- manner --

Column 4,
Line 11, change "means" to -- arrangement --
Line 13, change "Means" to -- Arrangement --
Line 27, change "adaption thus" to -- adaption may thus --
Line 27, change "assures" to -- assure --
Line 53, change "will be" to -- is --
Line 64, change "represents" to -- may represent --
Line 65, change "is capable" to -- may be capable --

Column 5,
Line 20, change "This is" to -- This may be --

Signed and Sealed this

Fifth Day of April, 2005

JON W. DUDAS
*Director of the United States Patent and Trademark Office*